US005356770A

United States Patent [19]

Lok et al.

[11] Patent Number: 5,356,770

[45] Date of Patent: Oct. 18, 1994

[54] COLOR PHOTOGRAPHIC MATERIALS AND METHODS WITH STABILIZED SILVER CHLORIDE EMULSIONS

[75] Inventors: Roger Lok; Jess B. Hendricks, III, both of Rochester, N.Y.

[73] Assignee: Eastman Kodak Compamn, Rochester, N.Y.

[21] Appl. No.: 127,531

[22] Filed: Sep. 28, 1993

Related U.S. Application Data

[63] Continuation of Ser. No. 890,884, May 29, 1992, abandoned.

[51] Int. Cl.[5] ..... G03C 1/09

[52] U.S. Cl. ..... 430/611; 430/600; 430/603; 430/629; 430/963

[58] Field of Search ..... 430/611, 600, 603, 629, 430/567, 963

[56] References Cited

U.S. PATENT DOCUMENTS

| | | | |
|---|---|---|---|
| H706 | 11/1989 | Takahashi et al. | 430/551 |
| T886,036 | 9/1969 | Kakenda et al. . | |
| 2,385,762 | 9/1945 | Mueller . | |
| 2,394,198 | 2/1946 | Mueller . | |
| 2,440,110 | 4/1948 | Mueller . | |
| 2,948,614 | 8/1960 | Allen et al. . | |
| 3,043,696 | 7/1962 | Herz et al. . | |
| 3,047,393 | 7/1962 | Herz et al. . | |
| 3,057,725 | 10/1962 | Herz et al. . | |
| 3,184,313 | 5/1965 | Rees et al. . | |
| 3,189,458 | 6/1965 | Herz . | |
| 3,226,232 | 12/1965 | Dersch et al. . | |
| 3,397,986 | 8/1968 | Milliken et al. . | |
| 3,403,025 | 9/1968 | Rees et al. . | |
| 3,404,980 | 10/1968 | Gilman, Jr. et al. . | |
| 3,447,925 | 6/1969 | Dersch et al. . | |
| 3,466,173 | 9/1969 | Ishikawa et al. . | |
| 3,615,431 | 10/1971 | Gilman, Jr. et al. . | |
| 3,761,277 | 9/1973 | Vandenberghe et al. . | |
| 4,243,748 | 1/1981 | Elsner et al. | 430/600 |
| 4,352,873 | 10/1982 | Toda et al. | 430/545 |
| 4,410,619 | 10/1983 | Kubbota et al. | 430/234 |
| 4,521,508 | 6/1985 | Sugimoto et al. | 430/567 |
| 4,620,205 | 10/1986 | Iiyama et al. | 346/204 |
| 4,699,873 | 10/1987 | Takahashi et al. | 430/446 |
| 4,914,009 | 4/1990 | Ueda et al. | 430/370 |
| 4,960,689 | 10/1990 | Nishikawa et al. | 430/603 |

FOREIGN PATENT DOCUMENTS

| | | |
|---|---|---|
| 325235 | 7/1989 | European Pat. Off. . |
| 0325235 | 7/1989 | European Pat. Off. . |
| 0367227 | 5/1990 | European Pat. Off. . |
| 54-69428 | 1/1976 | Japan . |
| 1006024 | 1/1976 | Japan . |
| 55-144236 | 11/1980 | Japan . |
| 1018139A | 1/1989 | Japan . |

*Primary Examiner*—Thorl Chea
*Attorney, Agent, or Firm*—Sarah Meeks Roberts

[57] ABSTRACT

Color photographic materials and methods employ a substrate bearing a silver chloride emulsion. The silver chloride emulsion includes a diamino disulfide and a sulfinate. The diamino disulfide and the sulfinate are included in a weight ratio of from about 1:1 to about 1:20, and provide improved storage stability and reduced high temperature sensitivity during exposure.

19 Claims, No Drawings

COLOR PHOTOGRAPHIC MATERIALS AND METHODS WITH STABILIZED SILVER CHLORIDE EMULSIONS

This application is a continuation of application Ser. No. 07/890,884 filed May 29. 1992, now abandoned.

FIELD OF THE INVENTION

The present invention relates to color photographic materials and methods employing stabilized silver chloride emulsions. More particularly, the invention relates to color photographic materials and methods wherein the silver chloride emulsions employed therein include a diamino disulfide and a sulfinate and exhibit improved storage stability and reduced sensitivity to high temperatures during exposure.

BACKGROUND OF THE INVENTION

Color photographic materials and methods commonly employ silver halide emulsions with silver chloride emulsions being particulary suitable in many applications. In photofinishing processes which use photosensitive paper to produce color prints, it is generally desirable to shorten the processing time. One way to shorten the processing time is to accelerate the development rate by increasing chloride content of the silver chloride emulsions, i.e., the higher the chloride content, the faster the development rate. However, it is often difficult to obtain high, invariant photosensitivity when higher chloride contents are employed. Typically, silver chloride emulsions exhibit increased fogging characteristics and emulsion sensitivity changes owing to high temperatures and/or humidity conditions which may be incurred during storage. The increases in fogging characteristics and the emulsion sensitivity changes may vary from layer to layer in a photographic material, thus resulting in increased color imbalance and a loss of quality in the printed material. These disadvantageous effects are increased with higher silver chloride contents.

Various attempts have been made to reduce fog formation during storage of photographic materials by the addition of stabilizing agents or deterioration inhibiting agents to the silver halide emulsions. For example, U.S. Pat. Nos. 2,440,110, 2,948,614, 3,043,696, 3,057,725, 3,226,232, 3,397,986, 3,447,925 and 3,761,277 and U.S. Publication No. T866,036 disclose the addition of various organic disulfide compounds to silver halide emulsions in order to reduce the increase in fogging characteristics in color photographic materials. However, disulfides which inhibit fog formation can also reduce emulsion sensitivity, thereby resulting in a loss in photographic speed. In fact, U.S. Pat. Nos. 3,184,313 and 3,403,025 disclose the use of disulfides to desensitize silver halide emulsions to visible radiation. Thus, a need exists for stabilizing silver halide emulsions against fogging without reducing the sensitivity of the emulsions, thereby preventing a loss in photographic speed.

Another disadvantage which is caused by the use of a high silver chloride content in color print paper is an increased sensitivity to high temperatures during exposure. The increased sensitivity can also contribute to changes in photographic speed. For example, when the temperature upon exposure rises, i.e., owing to heat from a lamp or the like during printing, the print density changes if the printing conditions are not adjusted to compensate for the rise in temperature, thereby making it very difficult if not impossible to obtain excellent quality prints. Additionally, an increase in temperature during exposure of the paper often results in a selective increase in speed in one layer, for example the cyan layer, over another light sensitive layer, such as the magenta layer, thereby resulting in an improper color balance in the color print. The photofinishing process must then be adjusted to compensate for this density fluctuation. As will be apparent, operating efficiency is decreased.

European Reference No. 367,227 discloses that the heat sensitivity of high content silver chloride color paper material may be reduced by employing certain spectral sensitizing dyes in combination with mercapto azoles. However, these dye structures do not appear to be entirely satisfactory in terms of minimizing thermal sensitivity while maintaining optimal sensitization efficiency. European Reference No. 325,235 discloses the use of iron ion donating compounds to reduce the change in sensitivity owing to exposure at elevated temperatures. Despite these attempts to reduce the thermal sensitivity of high content silver chloride emulsions during exposure, a need still exists for overcoming this problem.

SUMMARY OF THE INVENTION

Accordingly, it is an object of the present invention to provide improved color photographic materials and methods. It is a further object of the invention to provide color photographic materials and methods which may employ silver chloride emulsions containing a relatively high silver chloride content. It is a more specific object of the present invention to provide color photographic materials and methods employing stabilized silver chloride emulsions which exhibit improved storage stability and/or reduced high temperature sensitivity during exposure. Within the present specification, improvements in the storage stability of color photographic materials is generally indicated by a reduction in the increase in fogging characteristics which occur upon exposure to high temperatures and/or humidity during storage, without causing a loss in photographic speed as a result of a reduction in the emulsion sensitivity. Additionally, within the context of the present specification, a reduced sensitivity to high temperatures during exposure is indicated by a reduction in the change in photographic speed which occurs as a result of the high temperature exposure.

These and additional objects are provided by the materials and methods of the present invention. The color photographic materials of the invention comprise a substrate bearing a silver chloride emulsion wherein the silver chloride emulsion includes a diamino disulfide and a sulfinate. The diamino disulfide and the sulfinate are included in a weight ratio of from about 1:1 to about 1:20, and are included in an amount sufficient to improve the storage stability of the material and/or reduce the high temperatures sensitivity of the material during an exposure process. Applicants have surprisingly determined that color photographic materials employing a silver chloride emulsion containing a combination of the diamino disulfide and the sulfinate exhibit improved storage stability and a reduced sensitivity to high temperatures during exposure.

These and additional objects and advantages will be more fully apparent in view of the following detailed description.

DETAILED DESCRIPTION

The color photographic materials of the present invention comprise a substrate bearing a silver chloride emulsion. Suitable substrates are known in the art, and the substrate may be either transparent or reflective. Silver chloride emulsions are also generally well known in the color photographic art. The emulsions can include silver chloride grains of any conventional shape or size. Specifically, the emulsions can include coarse, medium or fine silver chloride grains. Useful tabular grain emulsions are described in *Research Disclosure*, Item 22534, January 1983 (published by Kenneth Mason Publications, Ltd., Dudley Annex, 12a North Street, Emsworth, Hampshire P010 7DQ, England) and in U.S. Pat. No. 4,748,106, both of which are incorporated herein by reference. High aspect ratio tabular grain emulsions are suitable, such as those disclosed by Wilgus et al U.S. Pat. No. 4,434,226, Daubendiek et al U.S. Pat. No. 4,424,310, Wey U.S. Pat. No. 4,399,215, Solberg et al U.S. Pat. No. 4,433,048, Mignot U.S. Pat. No. 4,386,145, Evans et al U.S. Pat. No. 4,504,570, Maskasky U.S. Pat. No. 4,400,463, Wey et al U.S. Pat. No. 4,414,306, Maskasky U.S. Pat. Nos. 4,435,501 and 4,4414,966 and Daubendiek et al U.S. Pat. Nos. 4,672,027 and 4,693,964, all of which are incorporated herein by reference. The silver halide emulsions can be either monodisperse or polydisperse as precipitated. The grain size distribution of the emulsions can be controlled by silver halide grain separation techniques or by blending silver halide emulsions of differing grain sizes.

As noted above, the photographic materials and methods of the invention are particulary advantageous for high chloride content emulsions. Preferably, the emulsions for use in the present materials and materials contain at least 50 weight percent silver chloride, and preferably at least 90 weight percent silver chloride. The remainder of the emulsions may comprise one or more other silver halide as is known in the art.

Sensitizing compounds, such as compounds of copper, thallium, lead, bismuth, cadmium and Group VIII noble metals, can be present during precipitation of the silver halide emulsion.

The emulsions can be surface-sensitive emulsions, i.e., emulsions that form latent images primarily on the surfaces of the silver halide grains, or internal latent image-forming emulsions, i.e., emulsions that form latent images predominantly in the interior of the silver halide grains. The emulsions are preferably negative-working emulsions.

The silver halide emulsions can be surface sensitized, and noble metal (e.g., gold), middle chalcogen (e.g., sulfur, selenium, or tellurium) and reduction sensitizers, employed individually or in combination, are suitable. Typical chemical sensitizers are listed in *Research Disclosure*, Item 17643, December 1978, incorporated herein by reference, Section III.

The silver halide emulsions can be spectrally sensitized with dyes from a variety of classes, including the polymethine dye class, which includes the cyanines, merocyanines, complex cyanines (i.e., tri-, tetra-, and polynuclear cyanines) and merocyanines, oxonols, hemioxonols, styryls, merostyryls, and streptocyoanines. Illustrative spectral sensitizing dyes are disclosed in *Research Disclosure*, Item 17643, cited above, Section IV.

Suitable vehicles for the emulsion layers and other layers of the materials of this invention are described in *Research Disclosure*, Item 17643, Section IX and the publications cited therein.

In accordance with an important feature of the present materials and methods, the silver chloride emulsion includes a diamino disulfide and a sulfinate. The sulfinate is preferably of the formula $RSO_2M$ wherein R is selected from the group consisting of alkyl, aryl arylalkyl and substituted aryl groups. Substituted aryl groups may contain one or more substituents, preferably selected from the group consisting of alkyl, alkoxy and halogen. Particularly preferred substituents for the aryl group comprise alkyl and alkoxy groups containing from 1 to about 6 carbon atoms. Additionally, R preferably contains from 1 to about 22 carbon atoms. In the formula RSO2M, M represents a monovalent metal or a tetraalkylamonium cation. Preferred monovalent metals for use in the sulfinate comprise sodium and potassium, with sodium being particulary preferred. These sulfinates may be commercially available or they may be produced by reduction of the corresponding sulfonyl chlorides in accordance with methods well known in the art. Preferred sulfinates include, but are not limited to, sodium phenyl sulfinate, sodium p-toluene sulfinate, sodium p-anisole sulfinate and sodium ethyl sulfinate. As will be demonstrated in the examples, sodium p-toluene sulfinate (TS) is a particularly preferred sulfinate for use in the present materials and methods.

The diamino disulfide compound which is employed in the materials and methods of the invention is preferably the formula

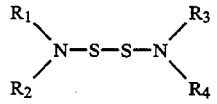

wherein $R_1$, $R_2$, $R_3$ and $R_4$ are individually selected from the group consisting of hydrogen, alkyl, aryl, heterocyclic rings, substituted aryl and substituted heterocyclic rings. In the heterocyclic rings, the heteroatom may comprise the amino nitrogen, wherein $R_1$ and $R_2$ form a ring with their common nitrogen atom, and/or $R_3$ and $R_4$ form a ring with their common nitrogen atom. The rings formed from $R_1$ and $R_2$, and/or $R_3$ and R4, preferably contain from about three to about six members and may include one or more additional heterocyclic atoms in addition to the amino nitrogen atom which is bonded to the disulfide moiety. The heterocyclic rings may additionally comprise one or more additional heteroatoms selected from S, O and N. Preferably, not more than two of the substituents $R_1$, $R_2$, $R_3$ and $R_4$ are hydrogen. The substituted aryl and substituted heterocyclic rings preferably include at least one substituent selected from the group consisting of alkyl, alkoxy and halogen.

Examples of suitable diamino disulfide compounds for use in the materials and methods of the present invention include, but are not limited to, the following compounds (1)–(16):

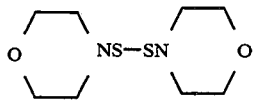

(1)

-continued
(2)
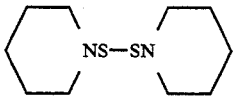
(3)
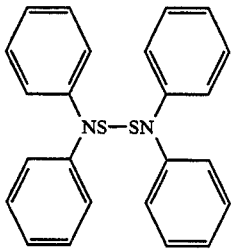
(4)
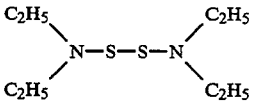
(5)
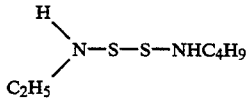
(6)
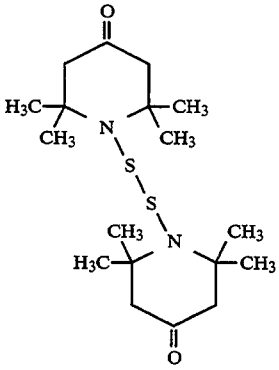
(7)
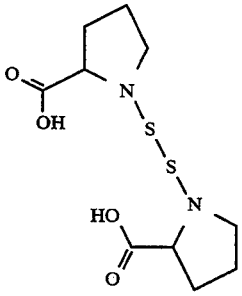
(8)
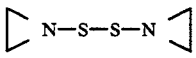
(9)
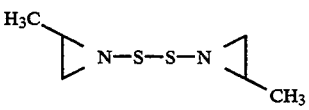
(10)
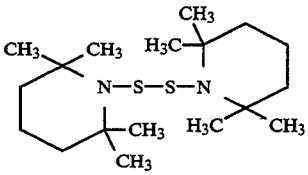
-continued
(11)
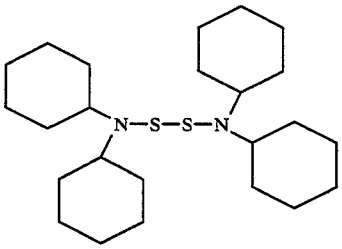
(12)
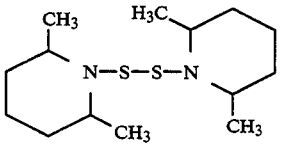
(13)
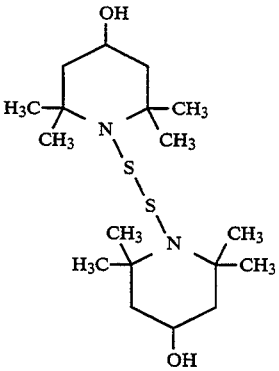
(14)
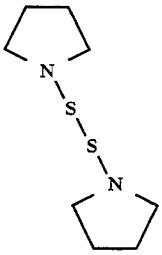
(15)
(16)
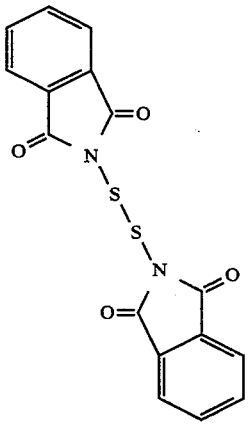
In a preferred embodiment, the diamino disulfide comprises morpholino disulfide (MDS), compound (1) set forth above.
Many of these diamino disulfides are commercially available. Alternatively, the diamino disulfides may be prepared by treatment of an amine with its chloroamine and elemental sulfur in potassium carbonate, for example as described in U.S. Pat. No. 4,656,266, incorporated herein by reference.

The diamino disulfide and the sulfinate are included in the silver chloride emulsion in a weight ratio of from about 1:1 to about 1:20. Applicants have determined that this ratio is particularly suitable in providing improved storage stability and reduced high temperature sensitivity to the color photographic materials . Additionally, it is preferred that the sulfinate is included in the silver chloride emulsions in an amount of from about 0.1 to about 100 mmole per mole of silver in the silver chloride emulsion, while it is preferred that the diamino disulfide is included in the silver chloride emulsion in an amount of from about 0.1 to about 10 mmole per mole of silver in the silver chloride emulsion. As will be demonstrated in the examples, these amounts are particularly suitable for providing the desired improvements in the color photographic materials.

The silver chloride emulsion employed in the present invention is prepared in a conventional manner, and the diamino disulfide and the sulfinate compounds may be added to the emulsion any time during its preparation. In a preferred embodiment, the diamino disulfide and the sulfinate are added to the silver chloride emulsion just prior to coating the emulsion on the supporting substrate. The disulfide compound may be added independently from the sulfinate compound, or the disulfide and the sulfinate may be added to the silver chloride emulsion as a mixture. For example, the disulfide may be dissolved in a solvent such as methanol and then mixed with an aqueous solution of the sulfinate, whereafter the resulting mixture is added to the silver chloride emulsion. In an alternate embodiment, the disulfide and/or the sulfinate may be added to the coupler dispersion which is coated simultaneously with the silver chloride emulsion melt. It is important to note that this embodiment, wherein the coupler dispersion is coated simultaneously with the emulsion melt, is considered to be within the scope of the invention in that the silver chloride emulsion will include the diamino disulfide and the sulfinate in the resulting color photographic material.

The photographic materials of the present invention may be simple elements or multilayer, multicolor elements. Multicolor elements contain dye image-forming units sensitive to each of the three primary regions of the spectrum. Each unit can be comprised of a single emulsion layer or of multiple emulsion layers sensitive to a given region of the spectrum. The layers of the element, including the layers of the image-forming units, can be arranged in various orders as known in the art.

A typical multicolor photographic element comprises a support bearing a cyan dye image-forming unit comprising at least one red-sensitive silver halide emulsion layer having associated therewith at least one cyan dye-forming coupler, a magenta image-forming unit comprising at least one green-sensitive silver halide emulsion layer having associated therewith at least one magenta dye-forming coupler and a yellow dye image-forming unit comprising at least one blue-sensitive silver halide emulsion layer having associated therewith at least one yellow dye-forming coupler. The element may contain additional layers, such as filter layers, interlayers, overcoat layers, subbing layers, and the like. The element typically will have a total thickness (excluding the support) of from 5 to 30 microns. The support may be transparent or reflective.

Suitable components for use in the color photographic materials of this invention are disclosed in *Research Disclosure*, December 1978, Item 17643; January 1983, Item 22534; and December 1989, Item No. 308119 published by Kenneth Mason Publications, Ltd., Dudley Annex, 12a North Street, Emsworth, Hampshire P010 7DQ, ENGLAND, the disclosures of which are incorporated herein by reference.

The elements of this invention can include any conventional couplers known in the art. Suitable couplers are described in Research Disclosure, Section VII, paragraphs D, E, F and G and the publications cited therein. These additional couplers can be incorporated as described in Research Disclosure, Section VII, paragraph C, and the publications cited therein. The couplers can be used with colored masking couplers as described in U.S. Pat. No. 4,883,746, image modifying couplers (including DIR's and timed or switched DIR's as disclosed in U.S. Pat. Nos. 3,148,062, 3,227,554, 3,773,201, 4,409,323 and 4,248,962, incorporated by reference) or with couplers that release bleach accelerators as described in European Patent Application No. 193,389.

The photographic elements of this invention can contain brighteners (Research Disclosure Section V), additional antifoggants and stabilizers (Research Disclosure Section VI), antistain agents and image dye stabilizers (Research Disclosure Section VII, paragraphs I and J), light absorbing and scattering materials (Research Disclosure Section VIII), hardeners (Research Disclosure X), coating aids (Research Disclosure Section XI), plasticizers and lubricants (Research Disclosure Section XII), antistatic agents (Research Disclosure Section XIII), matting agents (Research Disclosure Sections XII and XVI) and development modifiers (Research Disclosure Section XXI).

The photographic elements can be coated on a variety of supports as described in Research Disclosure Section XVII and the references described therein.

The photographic elements of the invention can be exposed to actinic radiation, typically in the visible region of the spectrum, to form a latent image as described in Research Disclosure Section XVIII, and then processed to form a visible dye image as described in Research Disclosure Section XIX. Processing to form a visible dye image includes the step of contacting the element with a color developing agent to reduce developable silver halide and oxidize the color developing agent. Oxidized color developing agent in turn reacts with the coupler to yield a dye.

Preferred color developing agents are p-phenylenediamines. Especially preferred are 4-amino-3-methyl-N,N-diethylaniline hydrochloride, 4-amino-3-methyl-N-ethyl-N-$\beta$-(methanesulfonamido)-ethylaniline sulfate hydrate, 4-amino-3-methyl-N-ethyl-N-$\beta$-hydroxyethylaniline sulfate, 4-amino-3-$\beta$-(methanesulfonamido)ethyl-N,N-diethylaniline hydrochloride and 4-amino-N-ethyl-N,N-diethylaniline hydrochloride and 4-amino-N-ethyl-N-(2-methoxyethyl)-m-toluidine di-p-toluenesulfonic acid.

With negative-working silver halide, the processing step described above provides a negative image. The described elements are preferably processed in the known C-41 color process as described in, for example, the *British Journal of Photography Annual,* 1988, pages 196–198.

Development is followed by the conventional steps of bleaching, fixing, or bleach-fixing, to remove silver or silver halide, washing, and drying.

The color photographic materials and methods of the present invention are demonstrated by the following examples, in which references are to parts by weight unless otherwise specified.

EXAMPLE 1

This example demonstrates the preparation of color photographic materials according to the present invention. Specifically, an emulsion in accordance with the present invention was prepared by adding morpholino disulfide (MDS) and sodium p-toluene sulfinate (TS) to a chemically and blue spectrally sensitized monodisperse silver chloride negative emulsion having a yellow dye-forming coupler, alpha-(4-(4-benzyloxy-phenyl-sulfonyl)phenoxy)-alpha(pivalyl)-2-chloro-5-(gamma-(2,4-di-5-amylphenoxy)butyramido)acetanilide (1.08 g/m$^2$), in di-n-butyl phthalate coupler solvent (0.27 g/m$^2$) and gelatin (1.51 g/m$^2$). The amounts of MDS and TS employed in Samples 1–5 of this example are set forth in Table I. In addition, 0.104 g of 1-(3-acetamidophenyl)-5-mercaptotetrazole and 1.033 g of potassium bromide per mole of silver were added. The emulsion (0.34 g Ag/m$^2$) was coated on a resin coated paper support, and 1.076 g/m$^2$) gel overcoat was applied as a protective layer together with a hardener, bis(vinylsulfonyl) methyl ether, in an amount of 1.8% of the total gelatin weight.

The speed and fog density for each sample emulsion were determined for the fresh emulsion at 0° F. by methods conventional in the art. The speed is defined as the amount of light required to reach a density of 1.0 on the developed strip. Fog density is defined as the minimum density of the coating. Samples of each emulsion were stored for one week at 120° F. and for two weeks at 120° F. After storage, the respective samples were developed. Specifically, the samples were given a 0.1 second exposure, using a 0–3 step tablet (0.15 increments) with a tungsten lamp designed to simulate a color negative print exposure source. The lamp had a color temperature of 3000° K., log lux 2.95. The coatings were exposed through a combination of magenta and yellow filters, a 0.3 ND (Neutral Density), and a UV filter. The processing consisted of a color development (45 sec, 35° C.), bleach-fix (45 sec, 35° C.) and stabilization or water wash (90 sec, 35° C.) followed by drying (60 sec, 60° C.). The chemistry used in the processor consisted of the following solutions.

| Developer | |
|---|---|
| Lithium salt of sulfonated polystyrene | 0.25 mL |
| Triethanolamine | 11.0 mL |
| N,N-diethylhydroxylamine (85% by wt.) | 6.0 mL |
| Potassium sulfite (45% by wt.) | 0.5 mL |

-continued

| | |
|---|---|
| Color developing agent (4-(N-ethyl-N-2-methanesulfonyl aminoethyl)-2-methyl-phenylenediamine-sesquisulfate monohydrate | 5.0 g |
| Stilbene compound stain reducing agent | 2.3 g |
| Lithium sulfate | 2.7 g |
| Potassium chloride | 2.3 g |
| Potassium bromide | 0.025 g |
| Sequestering agent | 0.8 mL |
| Potassium carbonate | 25.0 g |
| Water to total of 1 liter, pH adjusted to 10.12 | |
| Bleach-fix | |
| Ammonium sulfite | 58 g |
| Sodium thiosulfate | 8.7 g |
| Ethylenediaminetetracetic acid ferric ammonium salt | 40 g |
| Acetic acid | 9.0 mL |
| Water to total 1 liter, pH adjusted to 6.2 | |
| Stabilizer | |
| Sodium citrate | 1 g |
| Water to total 1 liter, pH adjusted to 7.2 | |

The speed and fog measurements for the fresh emulsion of each of samples 1–5 are set forth in Table I. Also set forth in Table I are the changes in speed (Delta speed) and in fog growth (Delta fog) for each stored material of each of samples 1–5, as compared with the fresh material. Finally, also set forth in Table I is the change in speed (Delta speed) resulting from heat sensitivity measurements. This heat sensitivity data was obtained on a sensitometer which was modified with a water jacket so that in a first exposure process, the temperature of the step tablet was maintained at 22° C., and in a second exposure process the temperature of the step tablet was increased to 40° C. The heat sensitivity data was obtained from the exposure and development of fresh emulsions. The change in speed due to the temperature variation was calculated at the 1.0 density point of the D long E curve, and indicates the sensitivity of the respective emulsions to changes in the exposure temperature.

TABLE I

| MDS mg Ag | TS mole | Sample | 0° F. Speed | 0° F. Fog | 1 week 120° F. vs. 0° F. Delta Speed | 1 week Delta Fog | 2 weeks 120° F. vs. 0° F. Delta Speed | 2 weeks Delta Fog | Heat Sensitivity 40° vs. 22° C. Delta Speed |
|---|---|---|---|---|---|---|---|---|---|
| 0.0 | 0.0 | 1 | 122 | 0.04 | 9 | 0.02 | 19 | 0.07 | 6 |
| 0.0 | 9600 | 2 | 124 | 0.03 | 11 | 0.02 | 21 | 0.07 | 6 |
| 120 | 0.0 | 3 | 010 | 0.02 | −3 | 0.03 | −7 | 0.10 | −12 |
| 120 | 1200 | 4 | 121 | 0.02 | 2 | 0.01 | 2 | 0.03 | 3 |
| 120 | 2400 | 5 | 122 | 0.03 | 4 | 0.01 | 4 | 0.03 | 3 |

As set forth Table I, sample 1 contained no MDS and no TS, and therefore was a control sample. Sample 2 represents a comparative sample in that it contains no MDS and a relative large amount of TS. Sample 3 also represents a comparative sample in that it contains MDS, but no TS. Finally, samples 4 and 5 are according to the present invention, containing both MDS and TS in the silver chloride emulsion. A comparison of samples 1 and 2 demonstrates that TS alone is inactive in the emulsion. A comparison of samples 1 and 3 demonstrates that MDS alone causes speed loss for both the fresh emulsion and the incubated emulsions. In contrast, samples 4 and 5 demonstrate the combination of MDS and TS in the silver chloride emulsion reduced fog growth and speed changes after storage. Additionally, while samples 1 and 2 exhibited an increase in speed upon exposure to high temperature, and sample 3 exhibited a significant loss in speed, samples 4 and 5 exhibited only a small increase in speed when exposed at a higher temperature (the Delta speed at 40° C. versus 22° C. for the exposure temperature).

EXAMPLE 2

In this example, sample emulsions 6–10 were prepared and processed in a manner similar to that described in Example 1, except that in this example, the paper base on which the emulsions were coated had been adjusted to a pH of 6.8. The speed and fog measurements, and changes therein are set forth in Table II.

TABLE II

| MDS mg Ag mole | TS mg Ag mole | Sample | 0° F. Speed | 0° F. Fog | 1 week 120° F. vs. 0° F. Delta Speed | 1 week 120° F. vs. 0° F. Delta Fog | 2 weeks 120° F. vs. 0° F. Delta Speed | 2 weeks 120° F. vs. 0° F. Delta Fog | Heat Sensitivity 40° vs. 22° C. Delta Speed |
|---|---|---|---|---|---|---|---|---|---|
| 0.0 | 0.0 | 6 | 123 | 0.02 | 5 | 0.02 | 11 | 0.022 | 5 |
| 0.0 | 9600 | 7 | 124 | 0.03 | 9 | 0.02 | 16 | 0.036 | 5 |
| 120 | 0.0 | 8 | 5 | 0.02 | −4 | 0.03 | −7 | 0.032 | −14 |
| 120 | 1200 | 9 | 123 | 0.02 | 2 | 0.01 | 2 | 0.007 | 3 |
| 120 | 2400 | 10 | 122 | 0.02 | 3 | 0.01 | 4 | 0.007 | 4 |

The results set forth Table II similarly demonstrate that samples 9 and 10 according to the present invention exhibited reduced speed changes and fog increases as compared with control samples 6 and comparative samples 7 and 8. Moreover, samples 9 and 10 exhibited a reduced change in speed when exposed at high temperature as compared with samples 6 and 7, and avoided the significant loss in emulsion sensitivity as compared with sample 8.

EXAMPLE 3

In this example, additional color photographic materials according to the present invention were prepared and processed. Specifically, a red sensitized emulsion was employed. The procedures set forth in Example 1 were followed except that the emulsion was coated at 0.18 g Ag/m$^2$, and the cyan dye-forming coupler 2-(alpha(2,4-di-tert-amyl-phenoxy)butyramido)-4,6-dichloro-5-ethyl phenol (0.42 g/m$^2$) in di-n-butyl phthalate coupler solvent (0.429 g/m$^2$) was employed. Additionally, the amounts of 1-(3-acetamidophenyl)-5-mercaptotetrazole and potassium bromide changed to 0.38 and 1.1 g per silver mole, respectively. Finally, samples of the materials of this example were stored for periods of 3 days (at 140° F.) and 1 week (at 120° F.), respectively. The speed and fog measurements, and the changes therein of samples 11–15 employed in this example are set forth in Table III.

TABLE III

| MDS mg Ag mole | TS mg Ag mole | Sample | 0° F. Speed | 0° F. Fog | 3 days 140° F. vs. 0° F. Delta Speed | 3 days 140° F. vs. 0° F. Delta Fog | 1 week 120° F. vs. 0° F. Delta Speed | 1 week 120° F. vs. 0° F. Delta Fog | Heat Sensitivity 40° vs. 22° C. Delta Speed |
|---|---|---|---|---|---|---|---|---|---|
| 0.0 | 0.0 | 11 | 154 | 0.09 | 19 | 0.47 | 5 | 0.18 | 7 |
| 0.0 | 9600 | 12 | 157 | 0.09 | 14 | 0.44 | 4 | 0.15 | 7 |
| 120 | 0.0 | 13 | 63 | 0.09 | 7 | 0.31 | 4 | 0.18 | −9 |
| 120 | 1200 | 14 | 152 | 0.09 | 3 | 0.06 | 0.7 | 0.02 | −2 |
| 120 | 2400 | 15 | 154 | 0.09 | 2 | 0.07 | 0.1 | 0.03 | −1 |

The results set forth Table III demonstrate the benefits of the combination of the diamino disulfide and a sulfinate in a red spectrally sensitized silver chloride emulsion. That is, while the use of MDS alone caused an intolerable speed loss in the emulsion (comparing 0° F. speed of samples 13 and 11), and TS alone had virtually no effect on the emulsion (comparing the speed, fog and changes therein of samples 12 and 11), samples 14 and 15 according to the invention exhibited reduced changes in speed and fog, and reduced speed changes upon exposure at high temperature, as compared with all of samples 11, 12 and 13.

EXAMPLE 4

In this example, additional color photographic materials according to the present invention were prepared. A green-sensitized emulsion was prepared and processed according to the procedures set forth in Example 1 except that the emulsion was coated at 0.27 g Ag/m$^2$, and the magenta dye-forming coupler 1-(2,4,6-di-trichlorophenyl)-3-(2-chloro-5-(alpha-(4-hydroxy-3-tert-butylphenoxy)-tetradecanoamido)anilino)-5-pyrazolone (0.42 g/m$^2$) in di-n-butyl phthalate coupler solvent (0.22 g/m$^2$) and gelatin (1.24 g/m$^2$) was employed. Additionally, the amount of 1-(3-acetamidophenyl)-5-mercaptotetrazole and potassium bromide were changed to 0.38 and 1.1 g per silver mole, respectively. Finally, samples of the materials of this example were stored for periods of 2 and 4 weeks at 120° F., respectively. The measurements of speed, fog and changes therein for samples 16–20 prepared in this example are set forth in Table IV.

TABLE IV

| MDS mg Ag mole | TS mg Ag mole | Sample | 0° F. Speed | 0° F. Fog | 2 weeks 120° F. vs. 0° F. Delta Speed | 2 weeks 120° F. vs. 0° F. Delta Fog | 4 weeks 120° F. vs. 0° F. Delta Speed | 4 weeks 120° F. vs. 0° F. Delta Fog | Heat Sensitivity 40° vs. 22° C. Delta Speed |
|---|---|---|---|---|---|---|---|---|---|
| 0.0 | 0.0 | 16 | 129 | 0.08 | 14 | 0.05 | 22 | 0.188 | 2 |
| 0.0 | 9600 | 17 | 129 | 0.08 | 13 | 0.07 | 23 | 0.220 | 2 |
| 120 | 0.0 | 18 | 82 | 0.10 | 14 | 0.03 | 18 | 0.130 | −16 |
| 120 | 1200 | 19 | 126 | 0.08 | 4 | 0.02 | 6 | 0.084 | −3 |

TABLE IV-continued

| MDS | TS | | | | 2 weeks 120° F. vs. 0° F. | | 4 weeks 120° F. vs. 0° F. | | Heat Sensitivity 40° vs. 22° C. |
|---|---|---|---|---|---|---|---|---|---|
| mg | | | 0° F. | | Delta | Delta | Delta | Delta | Delta |
| Ag mole | | Sample | Speed | Fog | Speed | Fog | Speed | Fog | Speed |
| 120 | 2400 | 20 | 126 | 0.08 | 3 | 0.02 | 5 | 0.093 | −1 |

The results set forth in Table IV demonstrate that samples 19 and 20 according to the present invention exhibited reduced speed and fog changes after storage as compared with samples 16, 17 and 18. It is again noted that the use of MDS alone (sample 18) caused an unacceptable speed loss in the fresh emulsion and a rise in fresh fog, while TS alone (sample 17) had no significant effect against the storage stability of the control sample 16. Samples 19 and 20 also exhibited reduced changes in speed when exposed at 40° C. as compared with exposure at 22° C., relative to samples 16, 17 and 18, thereby indicating that samples 19 and 20 exhibit reduced exposure temperature sensitivity.

EXAMPLE 5

In this example, color photographic materials according to the present invention were prepared wherein MDS and TS were added during the sensitization of the cyan emulsion. Specifically, on a paper support, the following layers 1–7 were coated, with layer 1 being adjacent to the support:

1. Blue sensitive layer: Chemically and blue spectrally sensitized monodisperse silver chloride negative emulsion ( 0.34 g/m$^2$ ) having a yellow dye-forming coupler alpha-(4-(4-benzyloxy-phenylsulfonyl)phenoxy)-alpha(pivalyl)-2-chloro-5-(gamma-(2,4-di-5-amylphenoxy)butyramido)acetanilide 1.08 g/m$^2$) in di-n-butyl phthalate coupler solvent (0.27 g/m$^2$) and gelatin (1.51 g/m$^2$).
2. Interlayer: Gelatin (0.76 g/m$^2$).
3. Green silver layer: Chemically and green spectrally sensitized monodisperse silver chloride negative emulsion (0.27 g/m$^2$) having magenta dye-forming coupler 1-(2,4,6-di-trichlorophenyl)-3-(2-chloro-5-(alpha-(4-hydroxy-3-tert-butylphenoxy)tetradecanoamido)anilino)-5-pyrazolone (0.42 g/m$^2$) in di-n-butyl phthalate coupler solvent (0.22 g/m$^2$) and gelatin (1.24 g/m$^2$).
4. UV absorbing layer: A mixture of hydroxyphenylbenzotriazoles (0.38 g/m$^2$) and gelatin (0.74 g/m$^2$).
5. Red sensitive layer: Chemically and red spectrally sensitized monodisperse silver chloride negative emulsion (0.18 g/m$^2$) having cyan dye-forming coupler 2-(alpha (2,4-di-tert-amyl-phenoxy)butyramido)-4,6-dichloro-5-ethyl phenol (0.42 g/m$^2$) in di-n-butyl phthalate coupler solvent (0.429 g/m$^2$) and gelatin (1.8 g/m2).
6. UV absorbing layer: A mixture of hydroxyphenylbenzotriazoles (0.38 g/m$^2$) and gelatin (1.08 g/m$^2$).
7. Overcoat layer: Gelatin (1.35 g/m$^2$).

The layers 1 to 7 were hardened with bis (vinylsulfonyl) methyl ether in an amount of 1.8% of the total gelatin weight.

The resulting materials were processed according to the procedures described in Example 1, except that the storage periods were two and four weeks, respectively. The speed, fog and changes therein for samples 21–25 prepared in this Example are set forth in Table V.

TABLE V

| MDS | TS | | 2 weeks 120° F. vs. 0° F. | | 4 weeks 120° F. vs. 0° F. | | Heat Sensitivity 40° vs. 22° C. |
|---|---|---|---|---|---|---|---|
| mg | | | Delta | Delta | Delta | Delta | Delta |
| Ag mole | | Sample | Speed | Fog | Speed | Fog | Speed |
| 0 | 0 | 21 | 0.107 | 0.008 | 0.234 | 0.070 | 0.108 |
| 20 | 200 | 22 | 0.074 | 0.006 | 0.161 | 0.053 | 0.077 |
| 40 | 400 | 23 | 0.048 | 0.005 | 0.096 | 0.037 | 0.056 |
| 80 | 800 | 24 | 0.034 | 0.004 | 0.084 | 0.021 | 0.027 |
| 120 | 1200 | 25 | — | — | 0.067 | 0.022 | 0.012 |

The results set forth in Table V demonstrate that the combination of a diamino disulfide and a sulfinate in the silver chloride emulsion is equally effective in improving the storage stability and the thermal sensitivity of the color photographic materials when added during the sensitization of the emulsion.

EXAMPLE 6

This example compares a color photographic material according to the present invention with a similar color photographic material wherein the silver chloride emulsion is substituted by a silver bromide emulsion. Specifically, a red spectrally and chemically sensitized silver chloride emulsion A and a similarly sensitized silver bromide emulsion B were prepared and processed according to the procedures set forth in Example 1. The change in fog after storage and the heat sensitivity change in speed for samples 26–29 prepared in this example are set forth in Table VI.

TABLE VI

| | MDS | TS | | 1 week 120° F. vs. 0° F. | 2 weeks 120° F. vs. 0° F. | Heat Sensitivity 40° vs. 22° C. |
|---|---|---|---|---|---|---|
| | mg | | | Delta | Delta | Delta |
| Emulsion | Ag mole | | Sample | Fog | Fog | Speed |
| A | 0.0 | 0.0 | 26 | 0.181 | 0.514 | 6 |
| A | 80 | 800 | 27 | 0.028 | 0.145 | −1.5 |
| B | 0.0 | 0.0 | 28 | 0.011 | 0.044 | 15 |

TABLE VI-continued

| Emulsion | MDS mg Ag mole | TS mg Ag mole | Sample | 1 week 120° F. vs. 0° F. Delta Fog | 2 weeks 120° F. vs. 0° F. Delta Fog | Heat Sensitivity 40° vs. 22° C. Delta Speed |
|---|---|---|---|---|---|---|
| B | 80 | 800 | 29 | 0.097 | 0.103 | 15 |

A comparison of samples 26 and 27 formed from the silver chloride emulsion A demonstrates that sample 27 containing MDS and TS exhibited a significantly smaller fog increase and a significantly smaller speed change at the higher exposure temperature as compared with sample 26 which did not contain MDS and TS. However, a comparison of samples 28 and 29 containing the silver bromide emulsion B demonstrates that sample 29 containing MDS and TS in the silver bromide emulsion exhibited increased fog as compared with sample 28 which did not contain MDS and TS, i.e. a result opposite to that of the present invention. Additionally, sample 29 did not exhibit reduced change in the speed at the high exposure temperature as compared with sample 28. Thus, the improvements provided by the diamine disulfide and the sulfinate in the silver chloride emulsions of the materials and methods of the present invention are not similarly exhibited in silver bromide emulsions.

EXAMPLE 7

In this example, comparative color photographic materials were prepared using disulfide compounds which are outside the scope of the diamine disulfide compounds employed in the materials and methods of the present invention. Specifically, red spectrally and chemically sensitized emulsions as prepared in Example 3 were prepared in this example except that the following disulfides C and D were employed in place of MDS used in Example 3. As in Example 3, the materials of this example were prepared and processed according to the procedures described in Example 1, with the exceptions noted in Example 3.

C

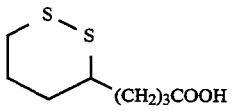

D

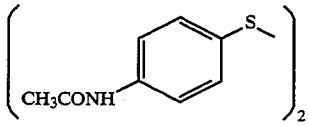

The measured speed, fog and changes therein of samples 30–35 prepared in this example are set forth in Table VII.

TABLE VII

| Disulfide Type | mg Ag mole | TS mg Ag mole | Sample | 0° F. Speed | 0° F. Fog | 3 days 120° F. Delta Speed | 3 days 120° F. Delta Fog | Heat Sensitivity 40° vs. 22° C. Delta Speed |
|---|---|---|---|---|---|---|---|---|
| none | 0.0 | 0.0 | 30 | 161 | 0.08 | 15 | 0.34 | 9 |
| none | 0.0 | 2400 | 31 | 162 | 0.08 | 14 | 0.31 | 10 |
| C | 448 | 0.0 | 32 | 159 | 0.09 | 12 | 0.31 | 11 |
| C | 448 | 4480 | 33 | 161 | 0.09 | 14 | 0.34 | 10 |
| D | 180 | 0.0 | 34 | 144 | 0.08 | 13 | 0.32 | 8 |
| D | 180 | 2400 | 35 | 145 | 0.08 | 15 | 0.35 | 9 |

A comparison of samples 32–35 with samples 30 and 31 demonstrate that disulfide compounds C and D offer little if any protection against the effects of storage and high temperature exposure in combination with sulfinates in silver chloride emulsions.

The preceding examples are set forth to illustrate specific embodiments of the invention and are not intended to limit the scope of materials and methods of the present invention. Additional embodiments and advantages within the scope of the claimed invention will be apparent to one of ordinary skill in the art.

What is claimed is:

1. A color photographic material, comprising a substrate bearing a silver chloride emulsion, the silver chloride emulsion including a diamino disulfide and a sulfinate, the diamino disulfide and the sulfinate being included in a weight ratio of from about 1:1 to about 1:20, the diamino disulfide being of the formula:

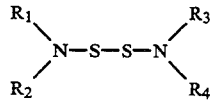

wherein $R_1$, $R_2$, $R_3$ and $R_4$ are individually selected from the group consisting of hydrogen, alkyl, aryl, heterocyclic rings, substituted aryl and substituted heterocyclic rings, said substituted aryl and substituted heterocyclic rings including at least one substituent selected from the group consisting of alkyl, alkoxy and halogen, or at least one of (a) $R_1$ and $R_2$ and (b) $R_3$ and $R_4$ form a substituted or unsubstituted heterocyclic ring.

2. A color photographic material as defined by claim 1, wherein the sulfinate is of the formula $RSO_2M$ wherein R is selected from the group consisting of alkyl, aryl, aralkyl and aryl containing at least one substituent selected from the group consisting of alkyl, alkoxy and halogen, and M is a monovalent metal or a tetraalkylammonium cation.

3. A color photographic material as defined by claim 2, wherein R is aryl.

4. A color photographic material as defined by claim 2, wherein R is aryl containing at least one substituent selected form alkyl and alkoxy.

5. A color photographic material as defined by claim 2, wherein R is alkyl.

6. A color photographic material as defined by claim 2, wherein M is sodium.

7. A color photographic material as defined by claim 2, wherein the sulfinate comprises sodium p-toluene sulfinate.

8. A color photographic material as defined by claim 1, wherein $R_1$ and $R_2$ form a heterocyclic ring and $R_3$ and $R_4$ form a heterocyclic ring.

9. A color photographic material as defined by claim 8, wherein each of said rings includes an O atom.

10. A color photographic material as defined by claim 9, wherein the diamino disulfide comprises morpholino disulfide.

11. A color photographic material as defined by claim 1, wherein $R_1$, $R_2$, $R_3$ and $R_4$ are the same.

12. A color photographic material as defined by clam 11, wherein $R_1$, $R_2$, $R_3$ and $R_4$ are each a phenyl group.

13. A color photographic material as defined by claim 11, wherein $R_1$, $R_2$, $R_3$ and $R_4$ are each an alkyl group.

14. A color photographic material as defined by claim 1, wherein the diamino disulfide is included in an amount of from about 0.1 to about 10 mmole per mole of silver in the silver chloride emulsion.

15. A color photographic material as defined by claim 1, wherein the sulfinate is included in an amount of from about 0.1 to about 100 mmole per mole of silver in the silver chloride emulsion.

16. A color photographic material as defined by claim 1, wherein the silver chloride emulsion contains at least 50 weight percent silver chloride.

17. A color photographic material as defined by claim 1, wherein the silver chloride emulsion is a negative emulsion.

18. A method for improving the storage stability of a color photographic material comprising a substrate bearing a silver chloride emulsion, said method comprising the steps of providing a diamino disulfide and a sulfinate in the silver chloride emulsion prior to storing the color photographic material, and storing the color photographic material, the diamino disulfide being of the formula:

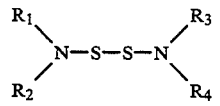

wherein $R_1$, $R_2$, $R_3$ and $R_4$ are individually selected from the group consisting of hydrogen, alkyl, aryl, heterocyclic rings, substituted aryl and substituted heterocyclic rings, said substituted aryl and substituted heterocyclic rings including at least one substituent selected from the group consisting of alkyl, alkoxy and halogen, or at least one of (a) $R_1$ and $R_2$ or (b) $R_3$ and $R_4$ form a substituted or unsubstituted heterocyclic ring.

19. A method for reducing the high temperature sensitivity of a color photographic material during an exposure process, said color photographic material comprising a substrate bearing a silver chloride emulsion, said method comprising the steps of providing a diamino disulfide and a sulfinate in the silver chloride emulsion prior to exposure of the color photographic material, and exposing the color photographic material, the diamino disulfide being of the formula:

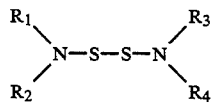

wherein $R_1$, $R_2$, $R_3$ and $R_4$ are individually selected from the group consisting of hydrogen, alkyl, aryl, heterocyclic rings, substituted aryl and substituted heterocyclic rings, said substituted aryl and substituted heterocyclic rings including at least one substituent selected from the group consisting of alkyl, alkoxy and halogen, or at least one of (a) $R_1$ and $R_2$ or (b) $R_3$ and $R_4$ form a substituted or unsubstituted heterocyclic ring.

* * * * *